US009229371B2

(12) United States Patent
Murakami et al.

(10) Patent No.: US 9,229,371 B2
(45) Date of Patent: Jan. 5, 2016

(54) DEVELOPER CONTAINER, DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Ryuta Murakami, Suntou-gun (JP); Daisuke Makiguchi, Izunokuni (JP); Toshiaki Takeuchi, Susono (JP); Yoshiyuki Batori, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/286,267

(22) Filed: May 23, 2014

(65) Prior Publication Data

US 2014/0356020 A1 Dec. 4, 2014

(30) Foreign Application Priority Data

May 31, 2013 (JP) ..... 2013-115561

(51) Int. Cl.
*G03G 15/08* (2006.01)

(52) U.S. Cl.
CPC ..... *G03G 15/0882* (2013.01); *G03G 15/0841* (2013.01); *G03G 15/0874* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 15/0882; G03G 15/0898; G03G 21/1676; G03G 2215/0682; G03G 2215/0687; G03G 2215/0875
See application file for complete search history.

(56) References Cited

U.S. PATENT DOCUMENTS

| | | | |
|---|---|---|---|
| 5,911,096 | A | 6/1999 | Batori et al. |
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |
| 6,714,746 | B2 | 3/2004 | Morioka et al. |
| 6,735,405 | B2 | 5/2004 | Yokoi et al. |
| 6,836,639 | B2 | 12/2004 | Karakama et al. |
| 6,898,392 | B2 | 5/2005 | Karakama et al. |
| 6,937,832 | B2 | 8/2005 | Sato et al. |
| 6,963,706 | B2 | 11/2005 | Morioka et al. |
| 6,987,938 | B2 | 1/2006 | Murakami et al. |

(Continued)

FOREIGN PATENT DOCUMENTS

JP 05-197288 8/1993

*Primary Examiner* — Ryan Walsh
(74) *Attorney, Agent, or Firm* — Fitzpatrick, Cella, Harper & Scinto

(57) ABSTRACT

A developer container includes: a developer accommodating chamber, provided with an opening, for accommodating a developer; a sealing member bonded to the developer accommodating container so as to block the opening; and a rotatable member, having a connecting surface where the sealing member is connected thereto, for peeling off the sealing member from the opening by rotation thereof. The connecting surface has a rectangular shape which has a long side with respect to a rotational axis direction of the rotatable member and which is twisted in a rotational direction of the rotatable member.

11 Claims, 12 Drawing Sheets

(56) References Cited

U.S. PATENT DOCUMENTS

| | | | |
|---|---|---|---|
| 7,024,131 | B2 | 4/2006 | Komatsu et al. |
| 7,079,787 | B2 | 7/2006 | Ogino et al. |
| 7,127,192 | B2 | 10/2006 | Batori et al. |
| 7,136,604 | B2 | 11/2006 | Chadani et al. |
| 7,156,797 | B2 | 1/2007 | Komatsu et al. |
| 7,200,349 | B2 | 4/2007 | Sato et al. |
| 7,206,534 | B2 | 4/2007 | Murakami |
| 7,418,225 | B2 | 8/2008 | Morioka et al. |
| 7,885,575 | B2 | 2/2011 | Batori et al. |
| 8,081,898 | B2 | 12/2011 | Batori et al. |
| 8,326,185 | B2 | 12/2012 | Asanuma et al. |
| 8,406,656 | B2 | 3/2013 | Batori et al. |
| 8,565,640 | B2 | 10/2013 | Batori et al. |
| 8,620,181 | B2 | 12/2013 | Murakami |
| 8,644,732 | B2 | 2/2014 | Kikuchi et al. |
| 8,676,085 | B1 | 3/2014 | Batori et al. |
| 2001/0033756 | A1* | 10/2001 | Shiratori et al. ..... 399/103 |
| 2014/0086620 | A1 | 3/2014 | Takeuchi et al. |
| 2014/0086621 | A1 | 3/2014 | Makiguchi et al. |
| 2014/0086632 | A1 | 3/2014 | Batori et al. |
| 2014/0093272 | A1 | 4/2014 | Matsumaru et al. |
| 2014/0105639 | A1 | 4/2014 | Kikuchi et al. |
| 2014/0126928 | A1 | 5/2014 | Batori et al. |
| 2014/0212166 | A1 | 7/2014 | Takeuchi et al. |
| 2014/0212181 | A1 | 7/2014 | Nakamura et al. |
| 2014/0348535 | A1 | 11/2014 | Murakami et al. |
| 2014/0376955 | A1 | 12/2014 | Takeuchi |
| 2014/0376969 | A1 | 12/2014 | Batori |
| 2015/0003865 | A1 | 1/2015 | Batori et al. |

* cited by examiner (a)

(b)

(a)

(b)

DEVELOPER CONTAINER, DEVELOPING CARTRIDGE, PROCESS CARTRIDGE AND IMAGE FORMING APPARATUS

FIELD OF THE INVENTION AND RELATED ART

The present invention relates to a developer container, a process cartridge and an image forming apparatus.

The image forming apparatus of an electrophotographic type forms an electrostatic latent image on a photosensitive member as an image bearing member by charging and exposure, and the electrostatic latent image is developed into a toner image with a toner as a developer, and then the toner image is transferred onto a recording material (medium), so that an image is formed no the recording material. Examples of the image forming apparatus include an image forming apparatus of a cartridge type for meeting replacement (exchange) of constituent members different in lifetime and meeting supply of consumables such as the toner. For example, as the cartridge, a developing cartridge prepared by integrally assembling a toner container, in which the toner is accommodated, with a developing roller and a process cartridge prepared by integrally assembling, in addition to the toner container and the developing roller, a photosensitive member, a charging means, a cleaning means and the like have been known. In such a cartridge, in order to prevent toner leakage during transportation or during the replacement, an opening of the toner container accommodating the toner is sealed in general with a seal member.

Japanese Laid-Open Patent Application (JP-A) Hei5-197288 proposes a constitution in which an end portion of the seal member for blocking a toner supply opening is mounted on a rotatable member such as a stirring member, and the seal member is, after the cartridge is mounted, wound up around the stirring member (rotatable member) by rotating the stirring member to unseal (expose) the toner supply opening. According to this constitution, a user is not required to unseal the seal member, and the seal member is rotated integrally with the stirring member after the unsealing of the seal member, and therefore there is no need to remove the seal member from the inside of the cartridge. Accordingly, the user is not required to dispose of the seal member, so that usability is improved.

However, in the case where a force required for peeling off the seal member from the toner supply opening by the stirring member is larger than a rotational torque during a normal stirring operation of the stirring member, there is a need, in some cases, to correspondingly increase capacity of a power source or correspondingly ensure part (element) strength of a driving system. As a result, there is a possibility of occurrences of upsizing and an increase in cost of the image forming apparatus.

SUMMARY OF THE INVENTION

A principal object of the present invention is to provide a developer container capable of reducing a peeling-off load of a seal member by a rotatable member.

According to an aspect of the present invention, there is provided a developer container comprising: a developer accommodating chamber, provided with an opening, for accommodating a developer; a sealing member bonded to the developer accommodating container so as to block the opening; and a rotatable member, having a connecting surface where the sealing member is connected thereto, for peeling off the sealing member from the opening by rotation thereof, wherein the connecting surface has a rectangular shape which has a long side with respect to a rotational axis direction of the rotatable member and which is twisted in a rotational direction of the rotatable member.

According to another aspect of the present invention, there is provided a developer container comprising: a developer accommodating chamber, provided with an opening, for accommodating a developer; a sealing member bonded to the developer accommodating container so as to block the opening; and a rotatable member, to which the sealing member is connected, capable of winding up the seal member by peeling off the sealing member from a bonding portion to the developer container by rotation thereof, wherein the rotatable member is constituted so that in a range from an end side to the other end side of a connecting portion to the sealing member with respect to the rotational axis direction, timing from start of winding-up of the sealing member until the sealing member is in a tension state between the rotatable member and the bonding portion is slower with an increasing distance from the end side and so that a speed of an increase in peeling-off amount of the sealing member after the sealing member is in the tension state is the same from the end side to the other end side.

According to another aspect of the present invention, there is provided a developing cartridge detachably mountable to a main assembly of an image forming apparatus, comprising: the above-described developer container; a developer carrying member for carrying the developer; and a developer supply chamber, in which the developer carrying member is provided, communicating with the developer accommodating chamber via the opening.

According to another aspect of the present invention, there is provided a process cartridge detachably mountable to a main assembly of an image forming apparatus, comprising: the above-described developer container; a developer carrying member for carrying the developer; and a developer supply chamber, in which the developer carrying member is provided, communicating with the developer accommodating chamber via the opening.

According to a further aspect of the present invention, there is provided an image forming apparatus for forming an image with a developer on a recording material; comprising: the above-described developer container; a developer carrying member for carrying the developer; and a developer supply chamber, in which the developer carrying member is provided, communicating with the developer accommodating chamber via the opening.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

Here, an electrophotographic image forming apparatus forms an image with a developer (toner) on a recording material by using an electrophotographic image forming process. For example, the image forming apparatus may include an electrophotographic copying machine, an electrophotographic printer (LED printer, laser beam printer or the like), an electrophotographic facsimile machine, an electrophotographic word processor, a multi-function machine (printer) having functions of these machines, and the like. Further, the recording material is a medium on which the image is to be formed, and is, e.g., a recording sheet, an OHP sheet, etc.

Further, a process cartridge is prepared by integrally assembling an electrophotographic photosensitive drum with, as a process means actable on the photosensitive drum, at least one of a charging device, a developing means and a cleaning means into a cartridge. Further, this process cartridge is constituted so as to be detachably mountable to an image forming apparatus main assembly.

Embodiment

General Structure of Image Forming Apparatus

Figure 2:
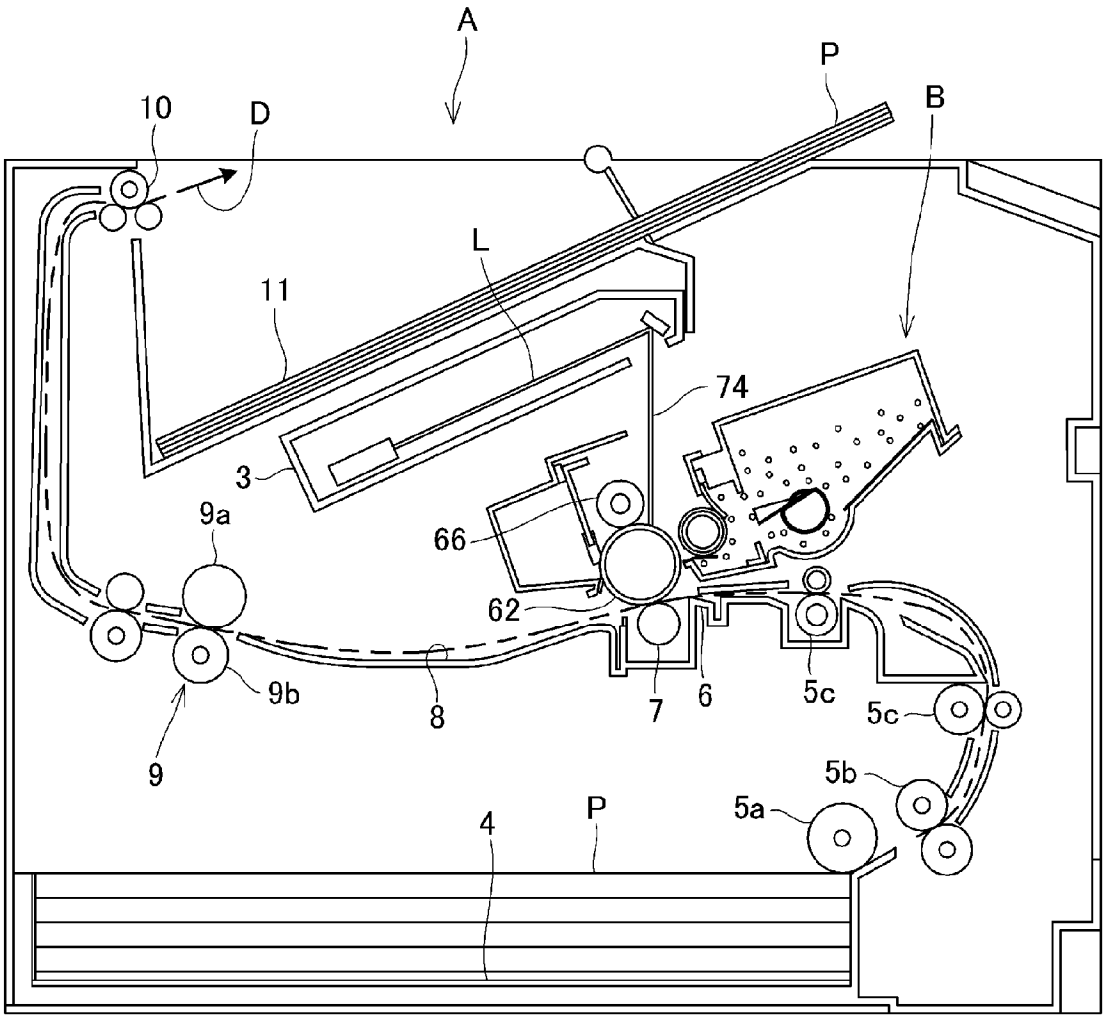
FIG. 2 is a sectional view of an image forming apparatus according to Embodiment.
Figure 3:
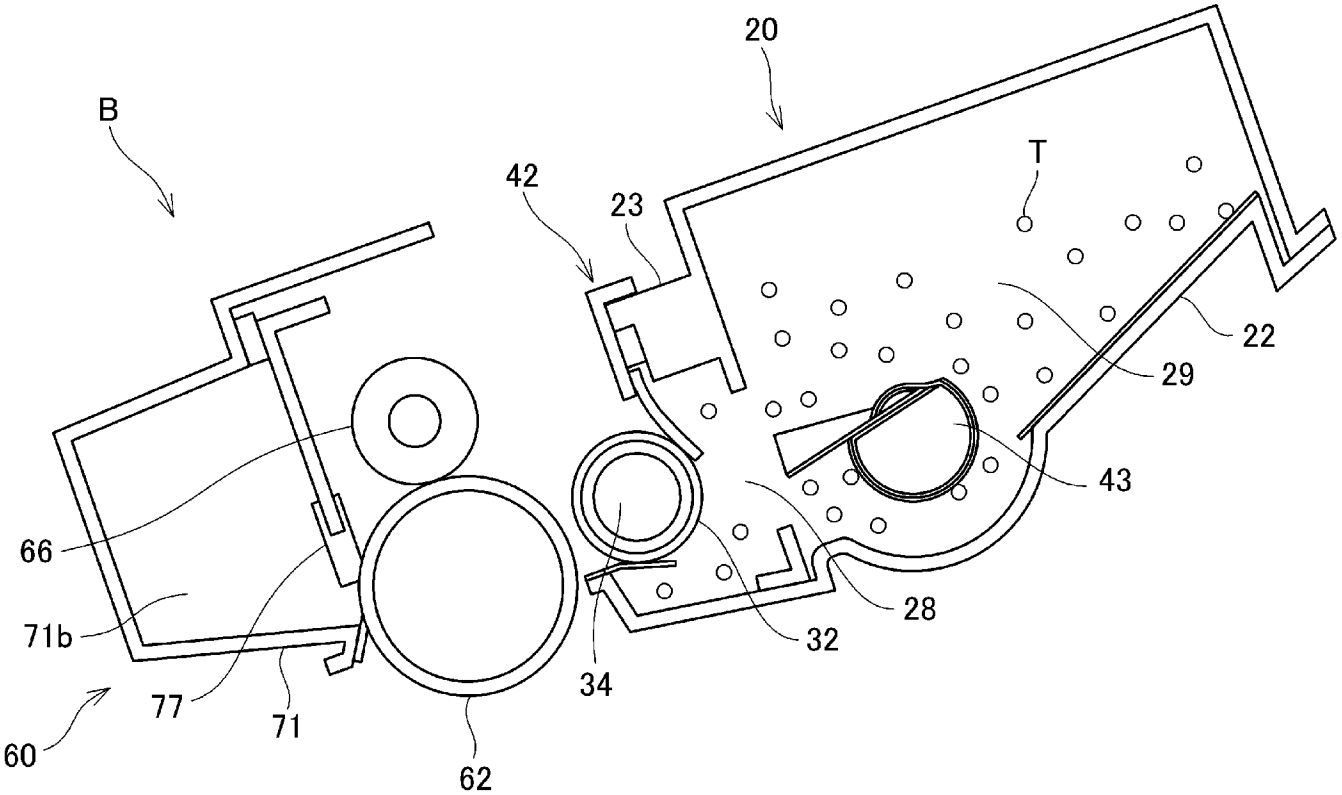
FIG. 3 is a sectional view of a process cartridge according to Embodiment.

With reference to FIGS. 2 and 3, a general structure of an image forming apparatus in this embodiment of the present invention will be described. FIG. 2 is a schematic sectional view showing a structure of the image forming apparatus in this embodiment. FIG. 3 is a schematic sectional view showing a structure of a process cartridge in this embodiment.

In the following description, a rotational axis direction of an electrophotographic photosensitive drum is referred to as a longitudinal direction. Further, with respect to the longitudinal direction, a side where the electrophotographic photosensitive drum receives a driving force from the main assembly of the image forming apparatus is referred to as a driving side (a driving force receiving portion 63*a* side shown in FIG. 5), and its opposite side is referred to as a non-driving side.

The image forming apparatus shown in FIG. 2 is a laser beam printer using an electrophotographic technique in which a process cartridge B is detachably mountable to an apparatus main assembly of the image forming apparatus. Here, the apparatus main assembly A of the image forming apparatus refers to a portion of the electrophotographic image forming apparatus from which the process cartridge B is removed.

In a state in which the cartridge B is mounted in the apparatus main assembly A, above the process cartridge B, an exposure device 3 (laser scanner unit) is provided. Further, below the cartridge B, a sheet (feeding) tray 4 in which a recording medium (sheet material P) as a recording material to be subjected to image formation is accommodated is provided.

Further, in the apparatus main assembly A, along a conveyance (feeding) direction D of the sheet material P, a pick-up roller 5*a*, a feeding roller pair 5*b*, a conveying roller pair 5*c*, a transfer guide 6, a transfer roller 7, a conveying guide 8, a fixing device 9, a discharging roller pair 10, a discharge tray 11 and the like are successively provided. Incidentally, the fixing device 9 is constituted by a heating roller 9*a* and a pressing roller 9*b*.

Image Forming Apparatus

As shown in FIG. 2, on the basis of a print start signal, an electrophotographic photosensitive drum 62 is rotationally driven at a predetermined peripheral speed (process speed) in an arrow R direction in FIG. 2. A charging roller 66 to which an unshown charging bias voltage is applied contacts the outer peripheral surface of the drum 62 and electrically charges the outer peripheral surface of the drum 62 uniformly. The exposure device 3 outputs laser light 3*a* depending on image information. The laser light L passes through an exposure window portion 74 provided at an upper surface of the cartridge B, so that the outer peripheral surface of the drum 62 is subjected to scanning exposure. As a result, on the outer peripheral surface of the drum 62, an electrostatic latent image depending on the image information is formed.

As shown in FIG. 3, in a developing device unit 20 as a developing device, a toner T as a developer in a toner chamber 29 as a developer accommodating chamber is stirred and fed by rotation of a feeding member 43, so that the toner T is sent to a toner supply chamber 28 as a developer supply chamber. The toner T is carried on a surface of a developing roller 32 as a developer carrying member by a magnetic force of a magnet roller 34 (fixed magnet). The toner T is regulated in layer thickness on a peripheral surface of the developing roller 32 by a developing blade 42 while being triboelectrically charged. The toner T is transferred onto the drum 62 depending on the electrostatic latent image, so that the electrostatic latent image is visualized (developed) as a toner image (developer member).

As shown in FIG. 3, in synchronism with output timing of the laser light L, by the pick-up roller 5*a*, the feeding roller pair 5*b* and the conveying roller pair 5*c*, the sheet material P is fed and conveyed from the sheet tray 4. Then, the sheet material P is conveyed to a transfer position (transferring) between the drum 62 and the transfer roller 7 via the transfer guide 6. At this transfer position, the toner image is successively transferred from the drum 62 onto the sheet material P. The sheet material P on which the toner image is transferred is separated from the drum 62 and then is conveyed to the fixing device 9 along the conveying guide 8. Then, the sheet material P passes through a fixing nip between the heating roller 9*a* and the pressing roller 9*b* which constitute the fixing device 9. At this fixing nip, pressure and heat fixing is effected, so that the toner image is fixed on the sheet material P. The sheet material P on which the toner image is fixed is conveyed to the discharging roller pair 10 and then is discharged onto the discharge tray 11.

As shown in FIG. 3, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

In this embodiment, the charging roller 66, the developing roller 32, and the cleaning blade 77 are the process means actable on the drum 62.

General Structure of Cartridge

Figure 4:
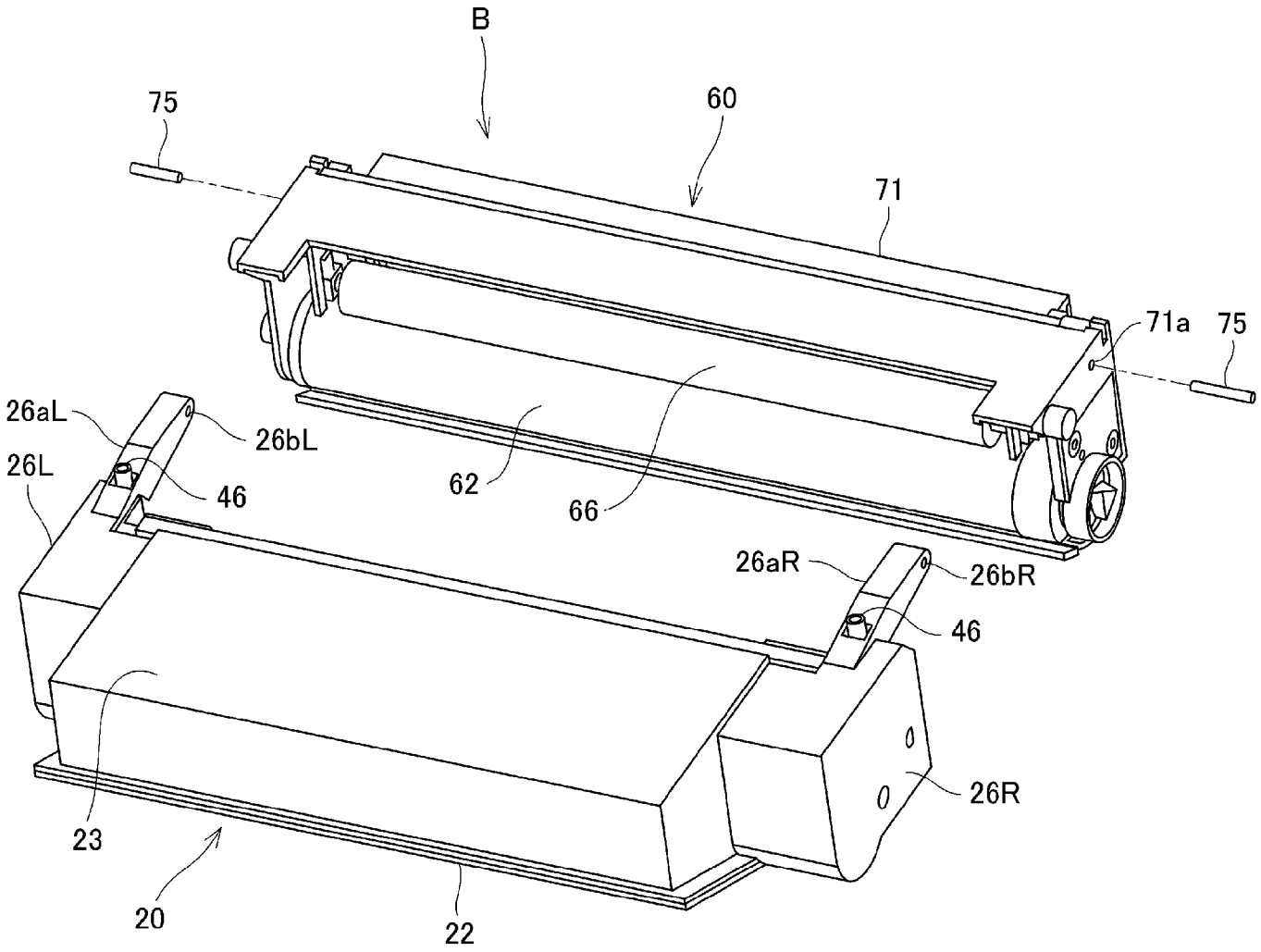
FIG. 4 is a perspective view for illustrating a structure of the process cartridge according to Embodiment.

With reference to FIGS. 3 and 4, a general structure of the cartridge B will be described. FIG. 4 is a perspective view for illustrating a structure of the cartridge B in this embodiment.

The cartridge B is constituted by combining the cleaning unit 60 and the developing device unit 20. The cleaning unit 60 is constituted by a cleaning frame 71, the drum 62, the charging roller 66, the cleaning blade 77 and the like. The developing device unit 20 is constituted by a developing container 23, a bottom member 22, first and second side members 26L and 26R, a developing blade 42, the developing roller 32, a magnet roller 34, the feeding member 43, the toner T, an urging member 46, and the like. The cleaning unit 60 and the developing device unit 20 are rotationally movably connected with each other by a connecting member 75, so that the cartridge B is constituted. Incidentally, the developing device unit 20 may also be provided independently from the cartridge B so as to be detachably mountable to the image forming apparatus main assembly or the cartridge B.

Specifically, at end portions of arm portions 26*a*L and 26*a*R formed on the first and second side members 26L and 26R provided at end portions of the developing device unit 20 with respect to a longitudinal direction of the developing device unit 20, rotational movement holes 26*b*L and 26*b*R in parallel with the developing roller 32 are provided. Here, the longitudinal direction of the developing device unit 20 is parallel to an axial direction of the developing roller 32. Further, at each of longitudinal end portions of the cleaning frame 71, an engaging hole 71*a* for permitting engagement therein of the connecting member 75 is formed. Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing device unit 20 are connected with each other rotatably about the connecting members 75. At this time, urging members 46 mounted at base portions of the arm portions 26*a*L and 26*a*R abut against the cleaning frame 71, so that the urging members 46 urge the developing device unit 20 toward the cleaning unit 60 with the connecting members 75 as the rotation centers. As a result, the developing roller 32 is pressed toward the photosensitive drum 62 with reliability. Then, by a gap (spacing) holding member 38 (FIG. 6) mounted at each of the end portions of the developing roller 32, the developing roller 32 is held with a predetermined gap from the drum 62.

Structure of Cleaning Unit

Figure 5:
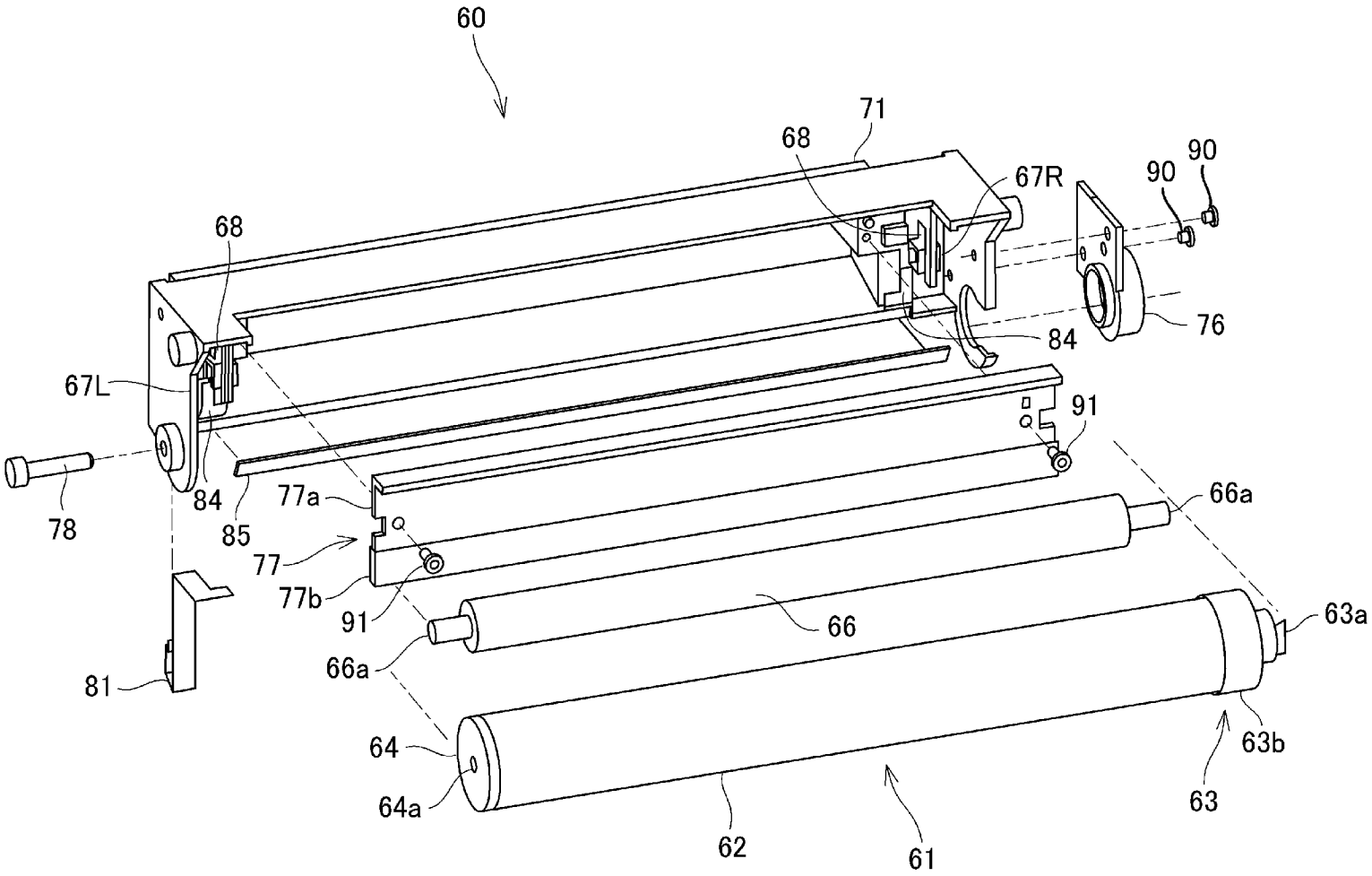
FIG. 5 is a perspective view for illustrating a structure of a cleaning unit according to Embodiment.

A structure of the cleaning unit 60 will be described with reference to FIG. 5. FIG. 5 is an exploded perspective view for illustrating the structure of the cleaning unit 60 in this embodiment.

A cleaning blade 77 is constituted by a supporting member 77*a* formed with a metal plate and an elastic member 77*b* formed of an elastic material such as urethane rubber, and is fixed on the cleaning frame 71 by screws 91 at longitudinal end portions of the supporting member 77*a*, thus being provided in a predetermined position. The elastic member 77*b* contacts the drum 62, so that the residual toner is removed from the outer peripheral surface of the drum 62. The removed toner is stored in the residual toner chamber 71*b* (FIG. 3). Incidentally, a receptor sheet 85 is provided in contact with the drum 62 at an opposing position to an end of the cleaning blade 77. An end portion seal 84 is provided for sealing between the cleaning frame 71 and each of end portions of the receptor sheet 85.

An electrode plate 81, an urging member 68 and charging roller bearings 67L and 67R are mounted on the cleaning frame 71.

A shaft portion 66*a* of the charging roller 66 is engaged into the charging roller bearings 67L and 67R. The charging roller 66 is urged toward the photosensitive drum 62 by the urging member 68, and is rotatably supported by the charging roller bearings 67L and 67R. Then, the charging roller 66 is rotated by rotation of the drum 62.

The drum 62 is connected integrally with flanges 63 and 64 and thus is constituted as an electrophotographic photosensitive drum unit 61. This connecting method uses caulking, bonding, welding or the like. To the flange 64, an unshown grounding contact and the like are connected. Further, the flange 63 includes a driving force receiving portion 63*a* for receiving a driving force from the apparatus main assembly A and includes a flange gear portion 63*b* for transmitting the driving force to the developing roller 32. The bearing member 76 is integrally fixed on the cleaning frame 71 with a screw 90 in the driving side, and the drum shaft 78 is press-fitted and fixed in the cleaning frame 71 in the non-driving side. Further, the bearing member 76 is engaged with the flange 63, and a drum shaft 78 is engaged with a hole 64*a* of the flange 64. As a result, the drum unit 61 is rotatably supported by the cleaning frame 71.

Developing Device Unit

Figure 6:
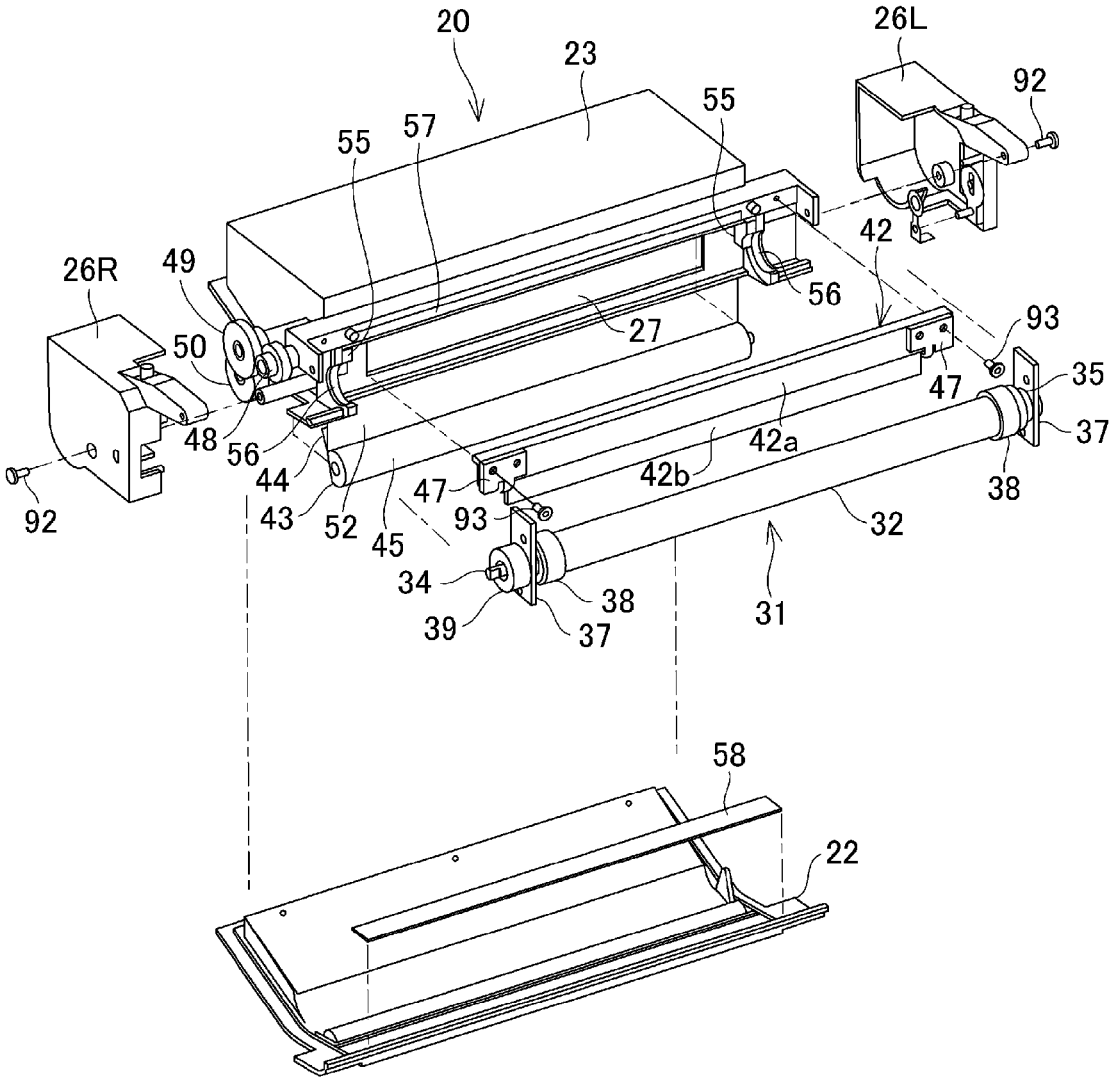
FIG. 6 is a perspective view for illustrating a structure of the developing device unit according to Embodiment.

A structure of the developing device unit 20 will be described with reference to FIG. 6. FIG. 6 is an exploded perspective view for illustrating the structure of the developing device unit 20 in this embodiment.

A developing (device) frame (developer container) consisting of the developing container 23 and the bottom member 22 defines the toner chamber 29 in which the toner T is accommodated, and the toner supplying chamber 28 (FIG. 3). The developing container 23 and the bottom member 22 are integrally connected with each other by welding or the like. The feeding member 43 is constituted by a feeding sheet 44 and a rotatable member 45. The feeding member 43 is supported by the developing container 23 in the non-driving side, and is supported by a feeding gear 50 mounted in the developing container 23 in the driving side. As a result, the feeding member 43 is rotated in the toner chamber 29 by the rotation of the feeding gear 50. The feeding member 43 has not only the function of feeding the toner T from the inside toward the outside of the toner chamber 29, i.e., toward the toner supplying chamber 28 but also the function as a stirring member for stirring the toner T in the toner chamber 29.

A first seal member 55, a second seal member 56 and a third seal member 57 and fixed at predetermined develops of the developer container 23 by a double-side tape or the like. A fourth seal member 58 is, after the developer container 23 and the bottom member 22 are connected with each other, fixed at a predetermined position of the bottom member 22 by the double-side tape or the like. The first seal member 55 prevents leakage at the toner T from each of longitudinal end portions of the elastic member 42*b* of the developing blade 42. The second seal member 56 prevents the leakage of the toner T from each of longitudinal end portions of the developing roller 32. The third seal member 57 is provided over the longitudinal direction and prevents the leakage of the toner T from a back side of the supporting member 42*a* of the developing blade 42. The fourth seal member 58 is provided over the longitudinal direction in contact with the developing roller 32 and prevents the leakage of the toner T from a lower side of the developing roller 32.

The developing blade 42 is constituted by a supporting member 42*a* formed with a metal plate and an elastic member 42*b* formed of an elastic material such as an urethane rubber, and is fixed together with a cleaning member 47 in a predetermined position relative to the developing container 23 by 93 at end portions of the supporting member 42*a*. A developing roller unit 31 is constituted by the developing roller 32, the magnet roller 34, a flange 35, the gap holding member 38, a bearing member 37, a developing roller gear 39 and the like. From an end portion of the developing roller 32 in the non-driving side, the magnet roller 34 is inserted, and at the end portion, the flange 35 is press-fitted and fixed. The gap holding member 38 is mounted at each of the end portions of the developing roller 32. Further, outside the gap holding member 38, the bearing member 37 is disposed, and in the driving side, the developing roller gear 39 is assembled outside the bearing member 37. By the bearing member 37 disposed at each of the end portions of the developing roller 32, the developing roller 32 is rotatably supported.

First and second gears 48 and 49 as a drive transmission member are rotatably engaged with the developing frame 1. As a result, the driving force receiving from the apparatus main assembly A is transmitted to the developing roller 32 and the feeding member 43 by successive engagement and rotation of the flange gear portion 63*b* (FIG. 5), the developing roller gear 39, the first and second gears 48 and 49, and the feeding gear 50. The first and second side members 26L and 26R are fixed with screws 92 at end portions, respectively, of the developing frame with respect to the longitudinal direction of the developing frame. At that time, the bearing members 37 of the developing roller unit 31 are held by the first and second side members 26L and 26R.

Structure of Toner Seal Member and Unsealing Operation

Toner Seal Member Toner Feeding Portion

Figure 1:
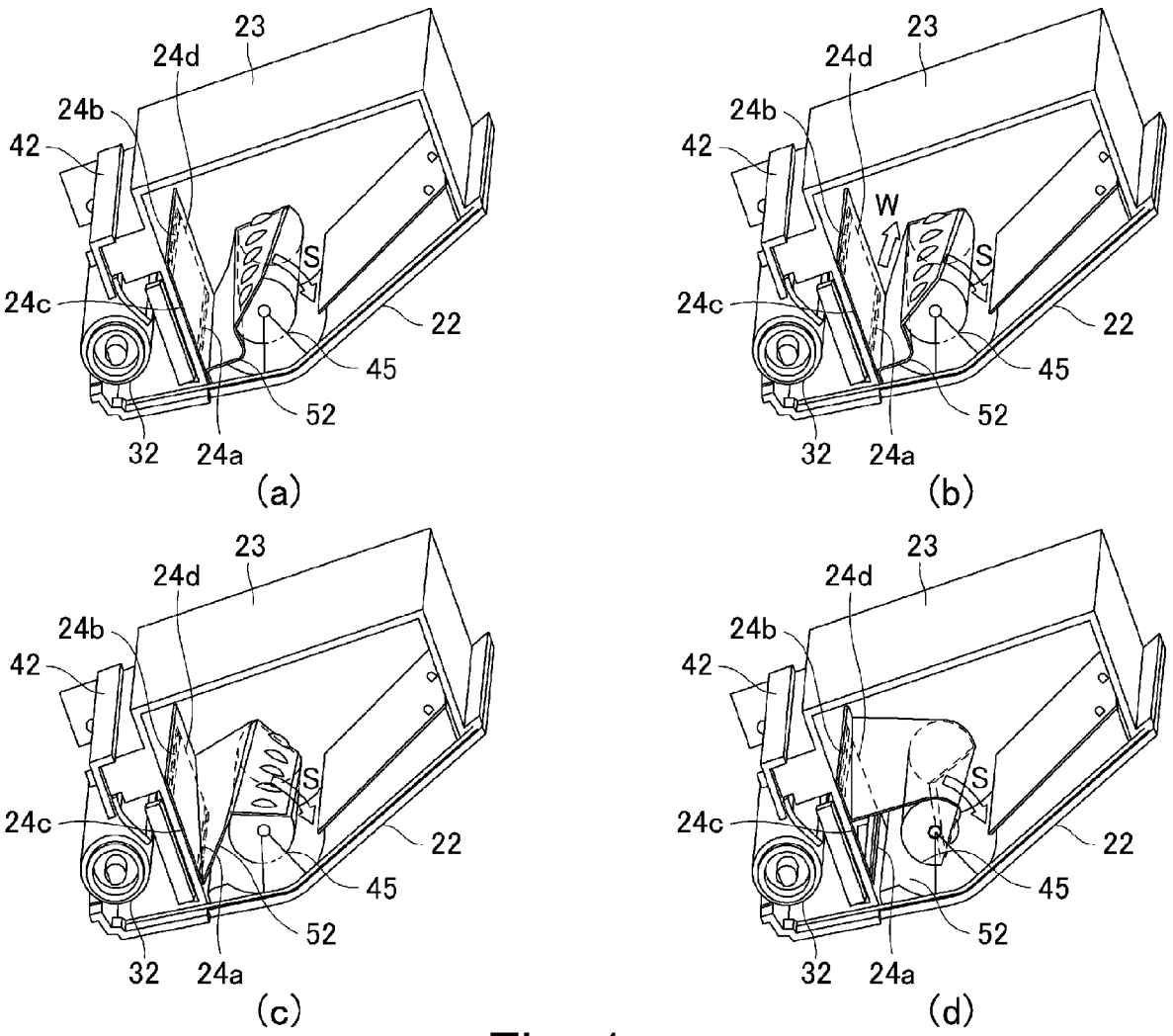
In FIG. 1, (*a*) to (*d*) are perspective views each showing a developing device unit according to Embodiment.
Figure 7:
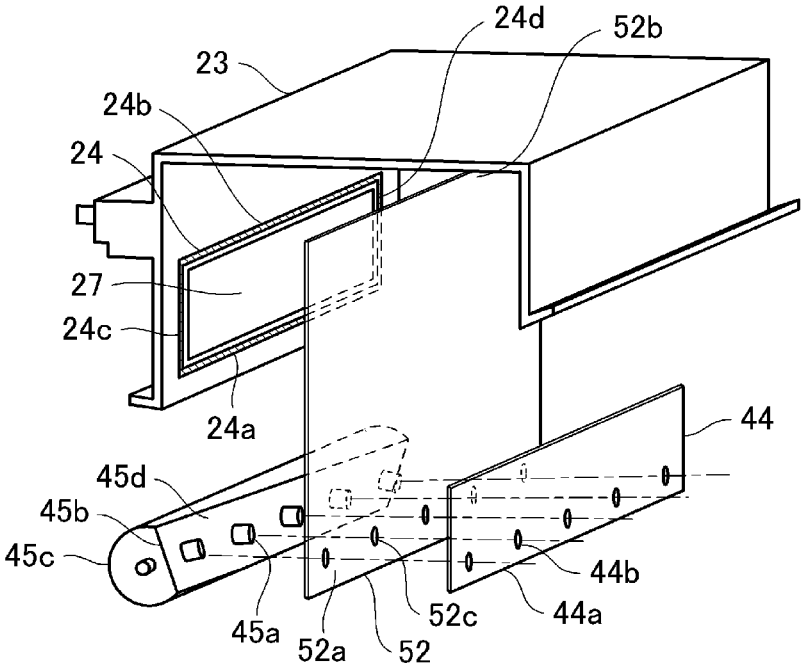
In FIG. 7, (*a*) and (*b*) are perspective views each for illustrating the structure of the developing device unit according to Embodiment.
Figure 7:
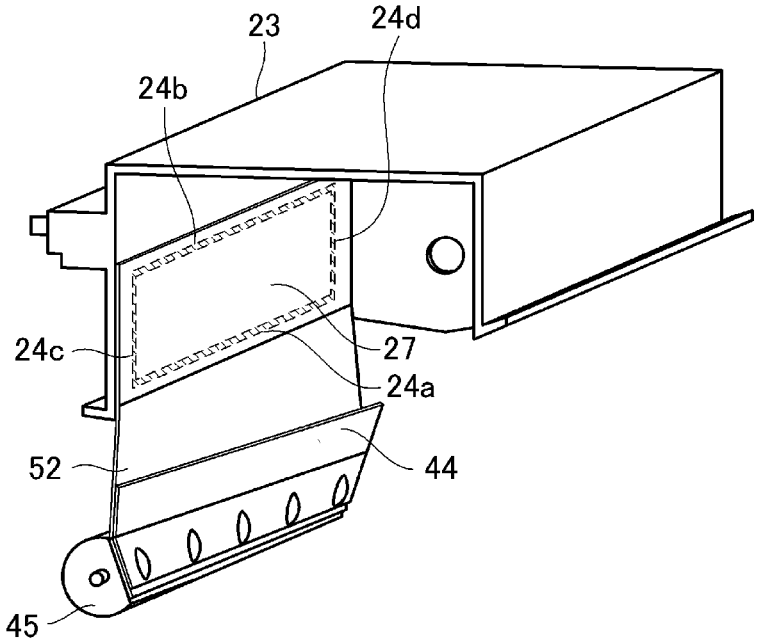
Figure 8:
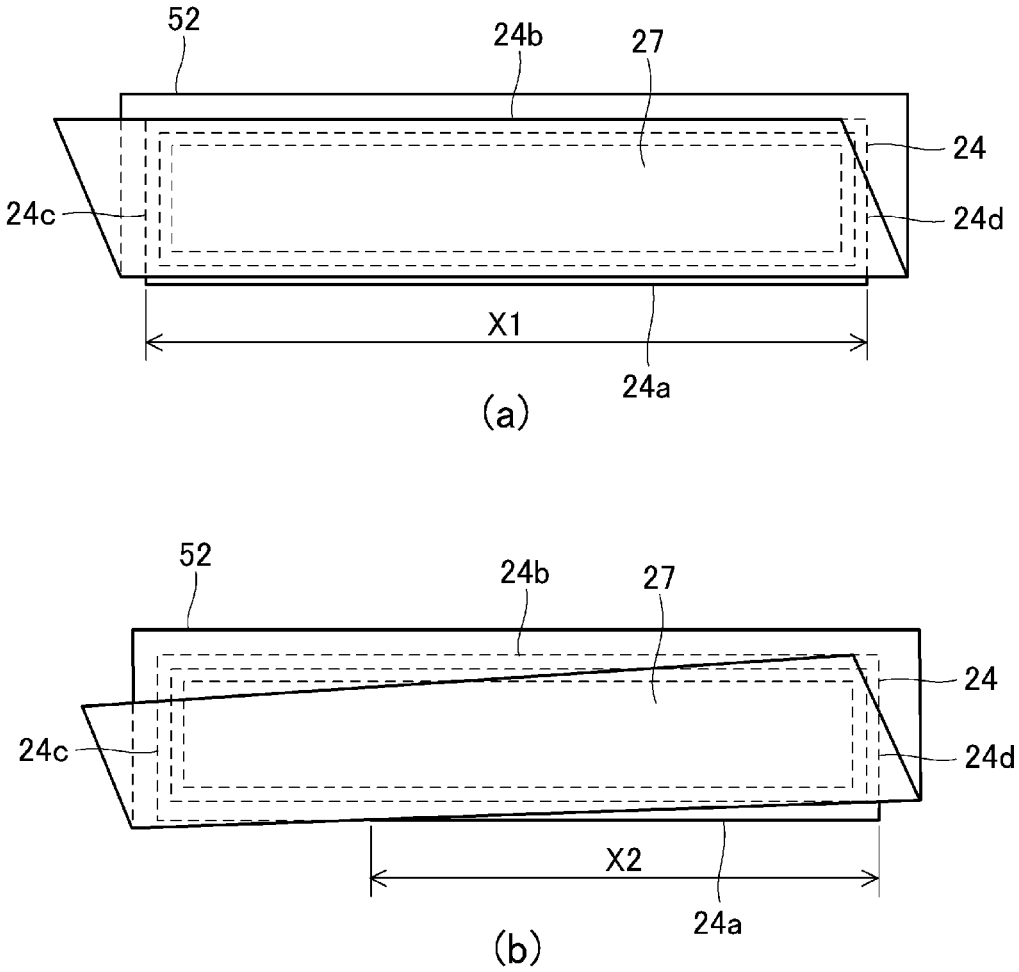
In FIG. 8, (*a*) and (*b*) are schematic views each for illustrating a peeling-off manner of a toner seal member in Embodiment.
Figure 9:
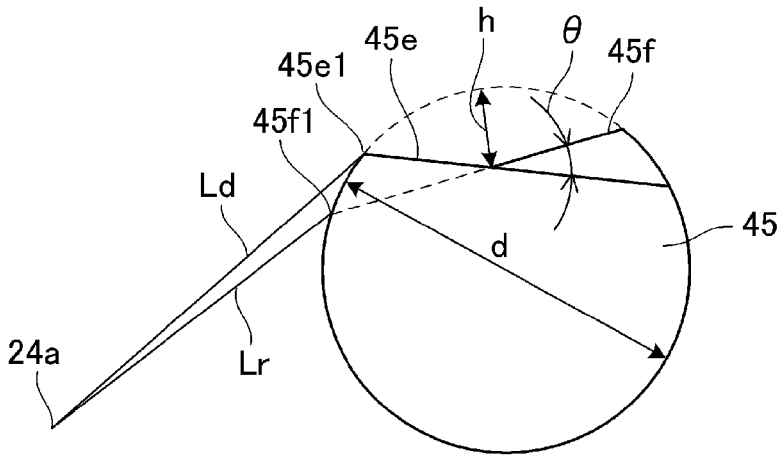
FIG. 9 is a schematic view for illustrating a twist angle of a toner seal member mounting surface of a rotatable member.
Figure 10:
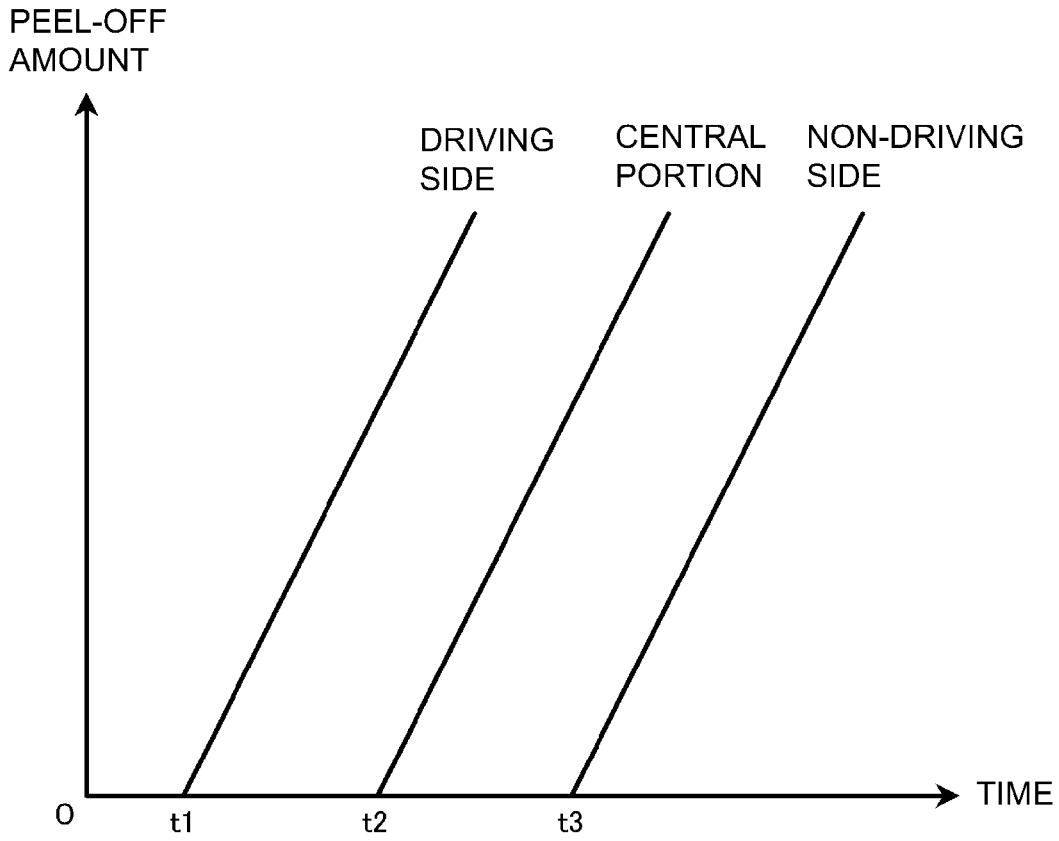
FIG. 10 is a graph for illustrating a difference in peeling-off timing of the toner seal member by the rotatable member.

With reference to (a) to (d) of FIG. 1 and (a) of FIG. 7 to FIG. 10, a toner seal structure will be described. In FIG. 1, (*a*) to (*d*) are perspective views showing an unsealing (removing) operation of the toner seal member in a time-series manner. In FIG. 7, (*a*) and (*b*) are schematic views for illustrating the toner seal structure, in which (*a*) is an exploded perspective view, and (*b*) is a perspective view. In FIG. 8, (*a*) and (*b*) are schematic views for illustrating a peeling-off manner of the toner seal member, in which (*a*) shows the peeling-off manner in Comparison Example, and (*b*) shows the peeling-off manner in this embodiment. FIG. 9 is a schematic view for illustrating a definition of a twist angle of the toner seal member mounting surface (connecting surface) of the rotatable member. FIG. 10 is a graph for illustrating a difference in peeling-off timing of the toner seal member depending on a longitudinal position of the toner seal member mounting surface of the rotatable member.

As shown in (a) of FIG. 7, the developing container 23 is provided with the toner supply opening 27 as an opening for establishing communication between the toner chamber 29 as a developer accommodating chamber and the toner supplying chamber 28 as a developer supplying chamber. The toner seal member 52 as the sealing member is constituted by a material compatible with a material for the developing container 23 or a material including an adhesive layer. The feeding sheet 44 is formed of a flexible material such as polyethylene terephthalate (PET), polycarbonate (PC) or polyphenylene sulfide (PPS).

The rotatable member 45 is constituted by an arcuate portion 45*c* and a rectilinear portion 45*b* in cross section as seen in the longitudinal direction. That is, the rotatable member 45 has a shape such that a cylindrical shape is partly cut away to form a first mounting surface connecting surface 45*d* to the toner seal member 52 at a cut-away portion. The mounting surface 45*d* has a rectangular shape having long sides with respect to a rotational axis direction of the rotatable member 45 and is twisted with respect to a rotational direction of the rotatable member 45. Specifically, the mounting surface 45*d* is twisted about an axis parallel to the rotation shaft so that a boundary line of the mounting surface 45*d* with a peripheral surface of the rotatable member 45 in an upstream side of the rotational direction S extends so as to be positioned in a more upstream side with the increasing distance from an (one) end side with respect to the rotational directions, and so that the other side is positioned downstream of the (one) end side with respect to the rotational direction S of the rotatable member 45. In this embodiment, the (one) end side is the driving side, and the other end side is the non-driving side. That is, the rotatable member 45 has a shape such that a portion thereof in the driving side is twisted relative to a portion thereof in the non-driving side with respect to the rotational direction S, and the shape follows a shape in the case where twist (torsion) is generated by application of a rotational driving force from an unshown driving means such as a motor during winding-up of the toner seal member 52.

As shown in FIG. 9, in this embodiment, the twist of the mounting surface 45*d* of the rotatable member 45 is defined by a twist angle θ (an angle of torsion (twist)). The twist angle θ is an angle formed by a driving side edge line 45*e* and a non-driving side edge line 45 of the rotatable member 45 as seen in the axial direction of the rotatable member 45. Further, a center line of the twist is located at a position where the center line is recessed by h from a phantom peripheral surface, of a circle having a diameter d, toward a rotation center of the rotatable member 45. In this embodiment, the twist angle is set in a range of 5-40 degrees.

As shown in (a) of FIG. 7, the toner seal member 52 has the same width as the rotatable member 45 with respect to the longitudinal direction (the rotational axis direction of the rotatable member 45). Further, a first end portion 52*a* as an end portion of the toner seal member 52 with respect to a direction (the rotational direction of the rotatable member 45) perpendicular to the longitudinal direction is provided with a plurality of holes 52*c*. Also the feeding sheet 44 is provided with a plurality of holes 44*b* at a first end portion 44*a* thereof as an end portion with respect to the direction perpendicular to the longitudinal direction. The first mounting surface 45*d* of the rotatable member 45 is provided with a plurality of projections 45*a*. The projections 45*a* are inserted into the holes 52*c* of the toner seal member 52 and the holes 44*b* of the feeding sheet in the listed order.

Thereafter, by thermally caulking the projections 45*a* of the rotatable member 45, the toner seal member 52, the feeding sheet 44 and the rotatable member 45 are integrally provided. Here, a method of integrating (connecting) the toner seal member 52, the feeding sheet 44 and the rotatable member 45 may also be another method using welding, snap-fitting, double-side tape or the like, and is not necessarily limited.

The toner seal member 52 is required to have a length in which the toner seal member 52 can cover the toner supply opening 27 and is mountable on the feeding member 43. Here, in order to prevent the end portion of the toner seal member 52, wound up by the rotatable member 45 after the toner supply opening 27 is unsealed, from contacting the end of the feeding sheet 44, the feeding sheet 44 and the toner seal member 52 have the same mounting phase.

As shown in (b) of FIG. 7 a second end portion 52*b* as the other end portion of the toner seal member 52 with respect to the direction perpendicular to the longitudinal direction is welded on the developing container 23 along an edge of the toner supply opening 27 by the thermal welding or the like. This welded portion is the sealing portion 24 as bonding portion. Here, the sealing portion 24 is configured to have a substantially rectangular shape, surrounding the toner supply opening 27, consisting of two sides extending in the longitudinal directions and other two sides extending in the direction perpendicular to the longitudinal direction. Specifically, the sealing portion 24 is constituted by a first sealing portion 24*a* and a second sealing portion 24*b* which are provided along a longitudinal direction of the toner supply opening 27 and by a third sealing portion 24*c* and a fourth sealing portion 24*d* which are provided along a widthwise direction (the direction perpendicular to the longitudinal direction) of the toner supply opening 27. The first sealing portion 24*a* is located in the first end portion 52*a* side of the toner seal member 52 with respect to the toner supply opening 27, and the second portion 24*b* is located in an opposite side (second end portion 52*a* side).

The third sealing portion 24*c* is located in the non-driving side of the toner seal member 52 with respect to the toner supply opening 27, and the fourth sealing portion 24*d* is located in the driving side. The first to fourth sealing portions 24*a* to 24*d* are continuously formed so as to enable sealing of the toner.

Incidentally, a method of applying the toner seal member 52 onto an edge of the toner supply opening 27 is not limited to the welding but may also be bonding via an adhesive member or a bonding method of application via an adhesive.

As shown in (a) of FIG. 1, the toner seal member 52 is constituted so as to be loosen at a portion between the welding portion thereof with the first sealing portion 24*a* and the holes 52*c* as an engaging portion in a state before the unsealing operation of the toner supply opening. As a result, even when some force acts on the rotatable member 45 during assembling and transportation of the process cartridge B, the toner seal member 52 is partly loosened and therefore application of tension to the toner seal member 52 is suppressed, so that a sealing force can be maintained.

Unsealing Operation of Toner Supply Opening

An unsealing operation of the toner supply opening 27 (a peeling-off operation of the toner seal member 52) performed at the time of start of use of the process cartridge B will be described with reference to (a) to (d) of FIG. 1, FIG. 3 and FIGS. 8-10. As shown in (a) of FIG. 1, when the process cartridge B is mounted in the apparatus main assembly A and receives the driving force from the apparatus main assembly A, the rotatable member 45 is rotated in an arrow S direction. When the rotatable member 45 is rotated, the toner seal member 52 is pulled in an arrow W direction ((b) of FIG. 1), thus being wound up by the rotatable member 45.

As shown in (b) of FIG. 1, by the twist of the first mounting surface 45*d*, the toner seal member 52 is pulled at a remoter position from the first sealing portion 24*d* in the driving side than in the non-driving side, and therefore the tension is applied to the toner seal member 52 earlier in the driving side than in the non-driving side. That is, a constitution in which timing from start of winding-up of the toner seal member 52 until the toner seal member 52 is placed in a tension state between the rotatable member 45 and the first sealing portion 24*a* is different with respect to the longitudinal direction is employed.

As shown in FIG. 9, by the twist of the first mounting surface 45*d*, a difference in phase is generated between the edge 45*e*1 in the driving side and the edge 45*f*1 in the non-driving side of the rotatable member 45. By this phase difference, a difference in length is generated between a line Ld connecting the edge 45*e*1 and the first sealing portion 24*a* in the driving side and a line Lr connecting the edge 45*f*1 and the first sealing portion 24*a* in the non-driving side, so that the timing until the toner seal member 52 is in the tension state with respect to the axial direction varies. In this embodiment, a constitution in which the timing until the toner seal member 52 is in the tension state is slower with an increasing distance from the driving side is employed.

As show in FIG. 10, the timing until the tension state of the toner seal member 52 is slower with the increasing distance from the driving side, so that a timing lag is generated in peeling-off of the toner seal member 52. That is, the peeling-off state of the toner seal member 52 is gradually created from the driving side toward the non-driving side. As shown in FIG. 10, the peeling-off state of the toner seal member 52 is first created at timing t1 in the driving side of the rotatable member 45, and then is successively created at timing t2 at a central portion of the rotatable member 45 and at timing t3 in the non-driving side of the rotatable member 45. A speed of an increase in a peeling-off amount (winding-up amount) from the peeling-off state of the toner seal member 52 is the same from the driving side to the non-driving side.

As shown in (c) and (d) of FIG. 1, when the rotatable member 45 is further rotated, the toner seal member 52 is obliquely peeled off from a boundary portion (corner) between the first and fourth sealing portions 24*a* and 24*d* toward a boundary portion (corner) between the second and third sealing portions 24*b* and 24*c*. That is, the toner seal member 52 is wound up by the rotatable member 45 so that the toner seal member 52 is gradually peeled off from a corner of the substantially rectangular sealing portion toward a diagonal corner of the corner in an oblique direction with respect to the longitudinal direction. As a result, the toner supply opening 27 is unsealed, so that a state in which the toner can be supplied from the toner chamber 29 to the toner supplying chamber 28 by the feeding member 43 is created (FIG. 3).

As shown in (a) of FIG. 8, in the case where the toner seal member 52 is peeled off uniformly with respect to the axial direction of the rotatable member 45 (Comparison Example), the peeling-off state of the seal member 52 is created simultaneously over the entire longitudinal region from the driving side to the non-driving side of the rotatable member 45. Particularly, the first sealing portion 24*a* is formed over the entire longitudinal region, so that at the rectangular sealing portion, a maximum peeling-off width with respect to the longitudinal direction is X1. Thus, a peeling-off manner is such that a maximum force for peeling off the toner seal member 52 is required at the first sealing portion 24*a*.

As shown in (b) of FIG. 8, in this embodiment, the peeling-off manner is such that a peeling-off area of the toner seal member 52 is gradually increased from the driving side toward the non-driving side of the rotatable member 45, so that a maximum peeling-off width X2 does not range over the entire longitudinal region, different from the case of Comparison Example ((a) of FIG. 8). At the time when the maximum peeling-off width X2 is created, in the driving side (the right side in (b) of FIG. 8), the peeling-off of the toner seal member 52 at the first sealing portion 24*a* is ended, and thereafter, an area in which the peeling-off of the toner seal member 52 is ended is to be gradually increased toward the non-driving side (the left side of (b) of FIG. 8). In the driving side, after the peeling-off at the first sealing portion 24*a* is ended, a state in which the fourth sealing portion 24*d* is peeled off is created, but a longitudinal peeling-off width of the fourth sealing portion 24*d* in the driving side is not changed from beginning to end, and therefore this state is maintained until the peeling-off at the first sealing portion 24*a* is ended in the non-driving side. Also the second sealing portion 24*b* is formed over the substantially entire longitudinal region, but similarly as in the case of the first sealing portion 24*a*, the peeling-off area is gradually increased from the driving side toward the non-driving side, and therefore the peeling-off width does not range over the entire longitudinal region different from the case of Comparison Example. Accordingly, in this embodiment, the toner seal member 52 can be peeled off from the sealing portion by a force smaller than a force in Comparison Example.

That is, in this embodiment, a boundary line between an area (bonding area) before the peeling-off of the toner seal member 52 and an area after the peeling-off of the toner seal member 52 in a range between the toner seal member 52 and the sealing portion extends in a direction oblique to the longitudinal direction. An angle of this boundary line with respect to the longitudinal direction varies depending on an amount of twist of the mounting surface 45*d* of the rotatable member 45. Accordingly, by adjusting the twist amount of the mounting surface 45*d*, the maximum peeling-off width X2 can be adjusted, so that a maximum of a rotational driving force, of the rotatable member 45, required for peeling off the toner seal member 52 can be reduced.

Incidentally, in this embodiment, as described above, the shape of the rotatable member 45 (the first mounting surface 45*d*) is formed so as to follow the shape in the case where the twist is generated by application of the rotational driving force from the driving means during the winding-up of the toner seal member 52. According to such a twisted shape, even when the twist amount of the first mounting surface 45*d* is not increased, a sufficient winding-up load-reducing effect of the toner seal member 52 by the rotatable member 45 can be obtained. Further, the twist amount of the first mounting surface 45*d* can be made small, so that a degree of localization of the toner feeding by the feeding sheet 44 with respect to the axial direction due to the mounting of the feeding sheet 44 on the twisted first mounting surface 45*d* can be decreased, and thus the amount of the toner remaining in the toner chamber 29 without being fed can be reduced.

As described above, according to this embodiment, a maximum load in an automatic winding-up operation of the toner seal member, in which the load is larger than the load during a normal operation such as the stirring operation can be reduced. Accordingly, it is possible to decrease the influence of the toner seal member winding-up load on a device specification. As a result, it becomes possible to reduce sizes of a motor and a driving system and to employ an inexpensive material, with the result that it is possible to realize downsizing and cost reduction of the electrophotographic image forming apparatus.

Other Embodiments

Figure 11:
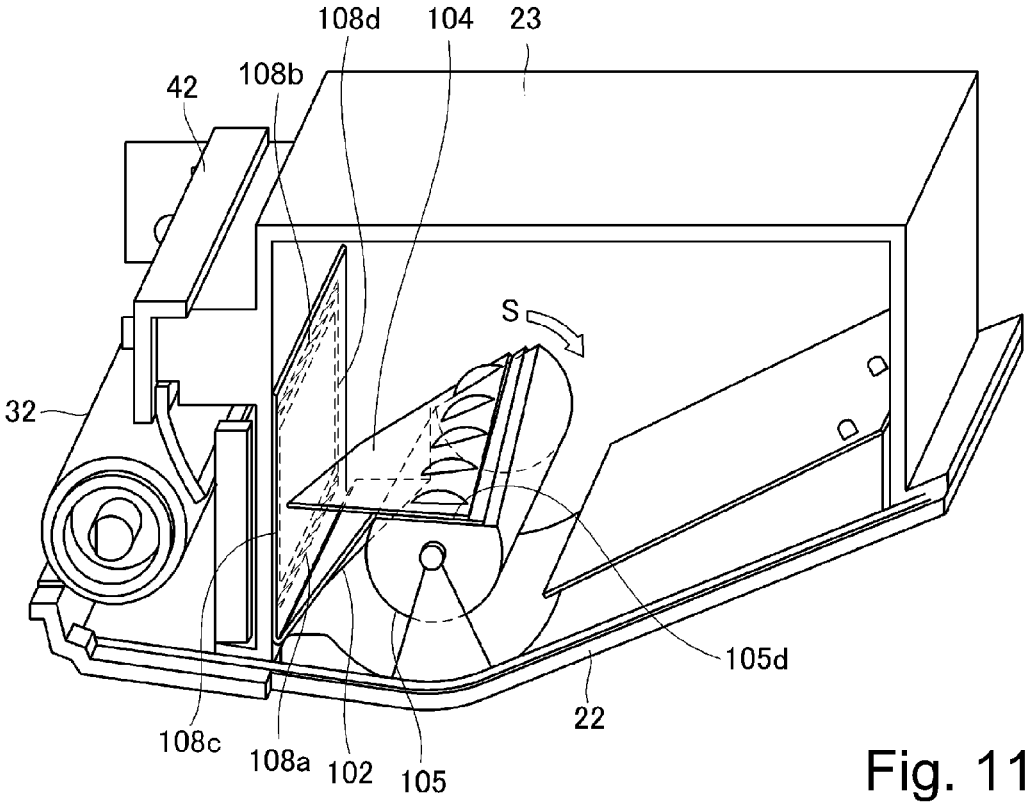
FIG. 11 is a perspective view for illustrating a structure of a developing device unit according to another embodiment.

FIG. 11 is a perspective view for illustrating another example of the toner seal structure. In the above-described embodiment, the twist direction of the mounting surface 45*d* of the rotatable member 45 is the same as the twist direction in the shape in the case where the twist of the rotatable member 45 is generated by the load during the winding-up of the toner seal member 52, but may also be an opposite direction as shown in FIG. 11.

Here, in a constitution shown in FIG. 11, a twist amount of a first mounting surface 105*d* of a rotatable member 105 is set at a value larger than a twist amount in the case where the twist of the rotatable member 105 is generated by a winding-up load of a toner seal member 102. Further, a cross-sectional shape is made larger so that polar moment of inertia of the rotatable member 105 is high in order to suppress a degree of localization of the toner feeding by a feeding sheet 104 with respect to the axial direction. Further, by using a material, having high modulus of rigidity, for the rotatable member 105, a twist amount of the rotatable member 105 by a load during the winding-up of the toner seal member 102 is decreased.

A driving force is applied to the rotatable member 105, whereby the toner seal member 102 is obliquely peeled off from a boundary portion between first and third sealing portions 108*a* and 108*c* toward a boundary portion between second and fourth sealing portions 108*b* and 108*d*. As a result, similarly as in the above-described embodiment, an effect of lowering a maximum load for peeling off the toner seal member 102 can be obtained.

Figure 12:
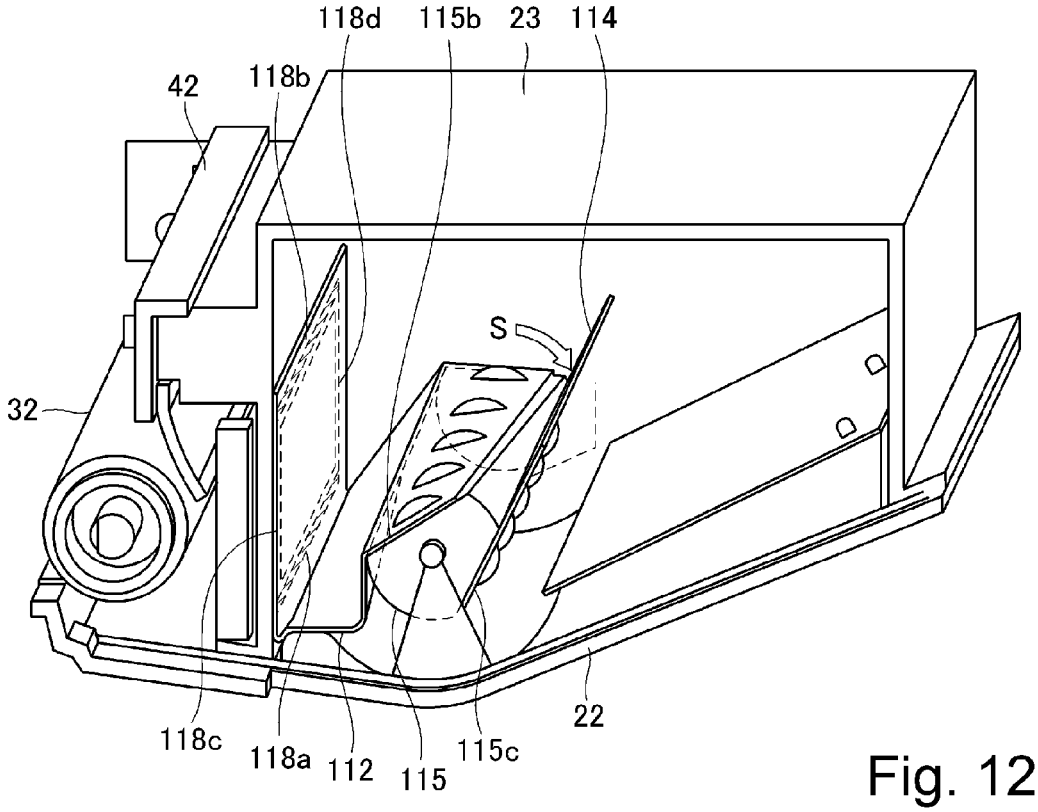
FIG. 12 is a perspective view for illustrating a structure of a developing device unit according to another embodiment.

FIG. 12 is a perspective view for illustrating another example of the structure of the rotatable member. In the above-described embodiment, the feeding sheet 44 is mounted together with the toner seal member 52 on the first mounting surface 45*d* of the rotatable member 45, but the present invention is not limited thereto. As shown in FIG. 12, a constitution in which a rotatable member 115 is provided with a twisted first mounting surface 115*b* and a second mounting surface 115*c* which is parallel to an axis thereof and on which a feeding sheet 144 is mounted may also be employed. As a result, an effect of similarly lowering a maximum load for peeling off a toner seal member 112 can be obtained. Further, a degree of twist of the feeding sheet 114 is decreased, and thus a degree of localization of toner feeding with respect to the axial direction can be further decreased, so that it is possible to reduce a residual toner amount. Incidentally, the rectangular sealing portion is constituted by first to fourth sealing portions 118*a* to 118*d*. Other constituent members are similar to those in the above-described embodiment.

Figure 13:
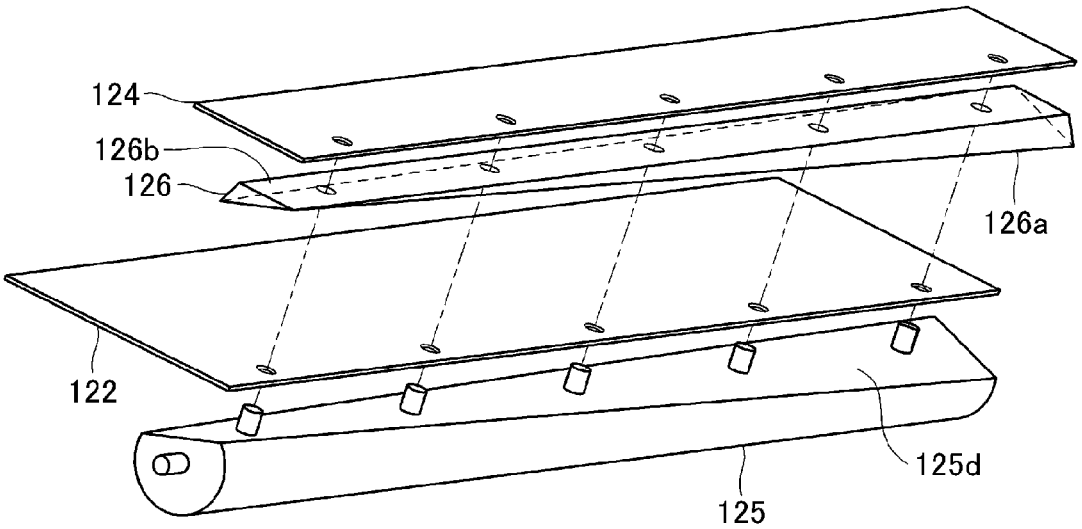
In FIG. 13, (*a*) and (*b*) are perspective views for illustrating structures of a feeding member and a developing device unit according to another embodiment.
Figure 13:
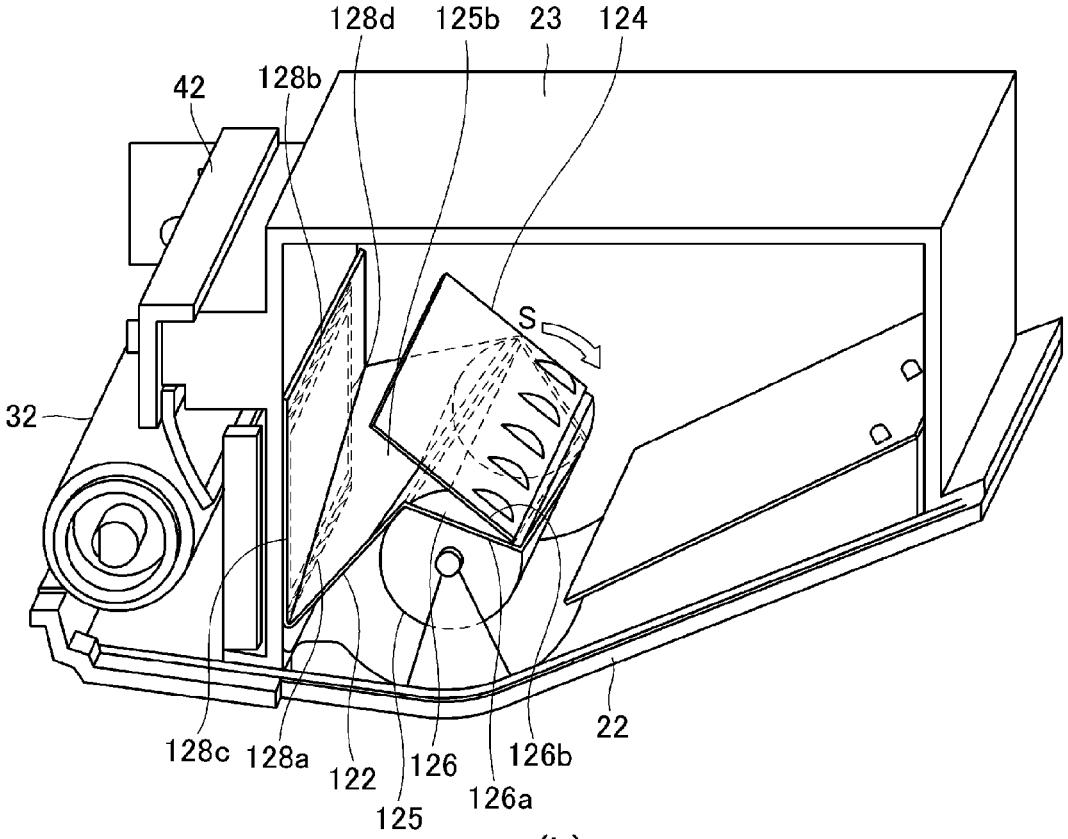

In FIG. 13, (*a*) and (*b*) are schematic views for illustrating another example of the structure of the rotatable member, in which (*a*) is an exploded perspective view, and (*b*) is perspective view. In the above-described embodiment, the feeding sheet 44 and the toner seal member 52 are provided superposedly on the first mounting surface 45*d* of the rotatable member 45, but as shown in FIG. 13, a constitution in which an auxiliary member 126 is provided so that a feeding sheet 124 is mounted in parallel to an axis of a rotatable member 125 may also be employed.

The auxiliary member 126 has a surface 126*a*, having a shape following a first mounting surface 125*d* of the rotatable member 125, and has another surface 126*b* parallel to the axis of the rotatable member 125. Further, a toner seal member 122, the auxiliary member 126 and the feeding sheet 124 are mounted in the listed order on the rotatable member 125. As a result, similarly as in the above-described embodiment, not only an effect of lowering a maximum load for peeling off the toner seal member 122 can be obtained but also a degree of twist of the feeding sheet 124 is decreased, so that it is possible to decrease a degree of localization of the toner feeding with respect to the axial direction to reduce the residual toner amount. Incidentally, the rectangular sealing portion is constituted by first to fourth sealing portions 128*a* to 128*d*. Other constituent members are similar to those in the above-described embodiment.

Figure 14:
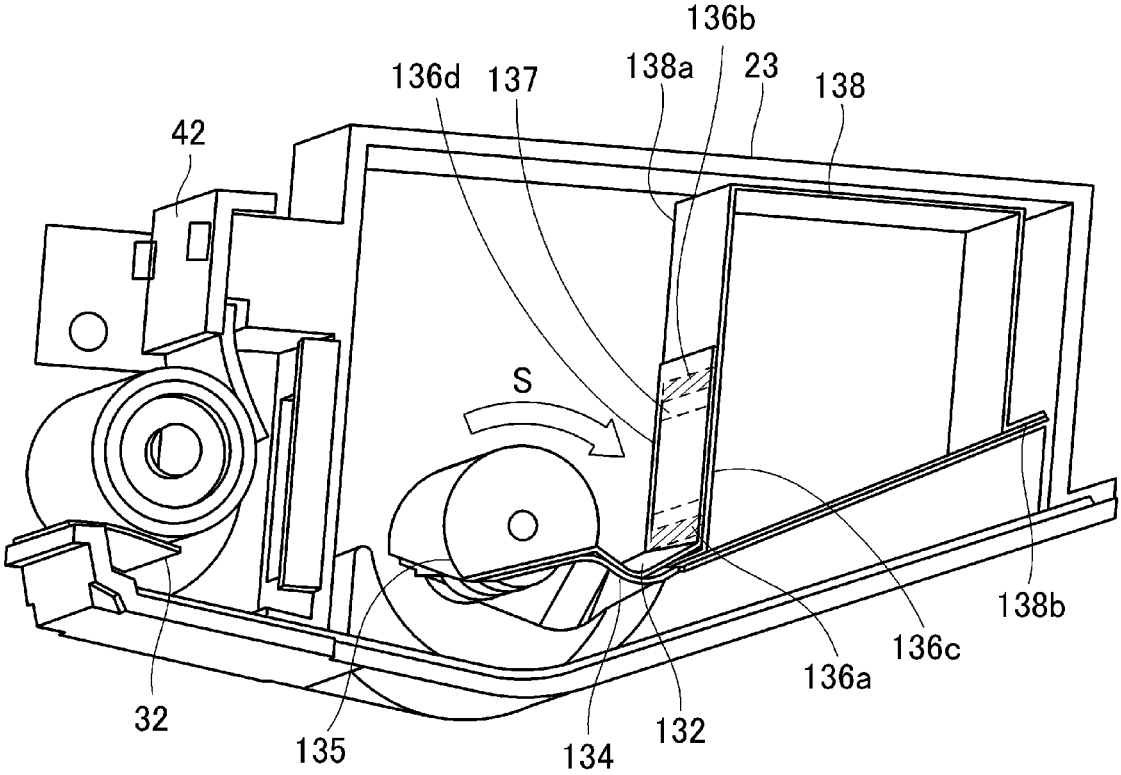
FIG. 14 is a perspective view for illustrating another example of the structure of the toner seal member.

FIG. 14 is a perspective view for illustrating another example of the structure of the toner seal member. In the above-described embodiment, the toner seal member 52 is welded on the developer container 23, but the present invention is not limited thereto. As shown in FIG. 14, a constitution in which a flexible container 138, of a flexible material, for accommodating the toner is fixed in the developer container 23 and a toner seal member 132 is welded along an edge of a toner supply opening 137 may also be employed. This flexible container 138 is constituted by first and second frames 138*a* and 138*b* which are bonded to each other by welding or the like. In this way, based on the flexibility of the container 138, an effect of further lowering a maximum load for peeling off the toner seal member 132 can be obtained. Incidentally, as shown in FIG. 14, a feeding sheet 134, a rotatable member 135, first to fourth sealing portions 136*a* to 136*d* and a toner supply opening 137 are provided. Other constituent members are similar to those in the above-described embodiment.

According to the present invention, it is possible to reduce the peeling-off load of the seal member by the rotatable member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 115561/2013 filed May 31, 2013, which is hereby incorporated by reference.

What is claimed is:

1. A developer container comprising:

a developer accommodating chamber, provided with an opening, for accommodating a developer;

a sealing member bonded to said developer accommodating chamber so as to block the opening; and a rotatable member, having a connecting surface where said sealing member is connected thereto, for peeling off said sealing member from said developer accommodating chamber by rotation thereof, wherein said connecting surface has a rectangular shape that has long sides with respect to a rotational axis direction of said rotatable member and the long sides are twisted between ends of the rectangular shape in a rotational direction of said rotatable member.

2. A developer container according to claim 1, wherein said sealing member is bonded to a rectangular bonding portion having two sides each extending a direction parallel to a rotation shaft of said rotatable member and two sides each extending in a direction perpendicular to said rotation shaft, and wherein said rotatable member winds up said sealing member so that said sealing member is peeled off gradually in an oblique direction to said rotation shaft from a corner of said rectangular bonding portion toward a diagonal corner thereof.

3. A developer container according to claim 1, wherein a rotational driving force is applied to an end of said rotatable member with respect to the rotational axis direction.

4. A developer container according to claim 1, wherein said rotatable member constitutes a feeding member for feeding the developer, accommodated in said developer accommodating chamber, to an outside of said developer accommodating chamber through the opening.

5. A developer container according to claim 1, wherein said rotatable member constitutes a stirring member for stirring the developer accommodated in said developer accommodating chamber.

6. A developing cartridge detachably mountable to a main assembly of an image forming apparatus, said developing cartridge comprising:

a developer container according to claim 1;

a developer carrying member for carrying the developer; and a developer supply chamber, in which said developer carrying member is provided, communicating with said developer accommodating chamber via the opening.

7. A process cartridge detachably mountable to a main assembly of an image forming apparatus, said process cartridge comprising:

a developer container according to claim 1;

a developer carrying member for carrying the developer; and a developer supply chamber, in which said developer carrying member is provided, communicating with said developer accommodating chamber via the opening.

8. An image forming apparatus for forming an image with a developer on a recording material, said image forming apparatus comprising:

a developer container according to claim 1;

a developer carrying member for carrying the developer; and a developer supply chamber, in which said developer carrying member is provided, communicating with said developer accommodating chamber via the opening.

9. A developer container comprising:

a developer accommodating chamber, provided with an opening, for accommodating a developer;

a sealing member bonded to said developer accommodating chamber so as to block the opening; and a rotatable member, to which said sealing member is connected, capable of winding up said seal member by peeling off said sealing member from a bonding portion to said developer accommodating chamber by rotation thereof, wherein said rotatable member is constituted so that in a range from an end side to the other end side of a connecting portion to said sealing member with respect to the rotational axis direction, timing from start of winding up of said sealing member until said sealing member is in a tension state between said rotatable member and said bonding portion is slower with an increasing distance from the end side and so that a speed of an increase in peeling off amount of said sealing member after said sealing member is in the tension state is the same from the end side to the other end side.

10. A developer container according to claim 9, wherein the peeling off amount of said sealing member until said sealing member is in the tension state is the same from the end side to the other end side.

11. A developer container according to claim 9, wherein said rotatable member has a shape such that a cylindrical shape is partly cut away to form a connecting surface to said sealing member at a cut away portion, and wherein said connecting surface is twisted about an axis parallel to said rotation shaft so that the other side is positioned downstream of the end side with respect to the rotational direction of said rotatable member and so that a boundary line of said connecting surface with a peripheral surface of said rotatable member in an upstream side of the rotational direction extends so as to be positioned in a more upstream side with the increasing distance from the end side with respect to the rotational direction.

* * * * *